United States Patent [19]

Paquette

[11] 4,305,118

[45] Dec. 8, 1981

[54] PORTABLE UTILITY CASE

[76] Inventor: Roland Paquette, 4307 - 6th St., Chomedey, Laval, Canada, H7W 2C6

[21] Appl. No.: 43,659

[22] Filed: May 30, 1979

[30] Foreign Application Priority Data

May 30, 1978 [GB] United Kingdom ..... 23970/78

[51] Int. Cl.[3] ..... F21V 33/00

[52] U.S. Cl. ..... 362/101; 362/201; 362/253

[58] Field of Search ..... 362/101, 201, 253

[56] References Cited

U.S. PATENT DOCUMENTS 2,697,297 12/1954 Newberg ..... 362/201

*Primary Examiner*—Stephen J. Lechert, Jr.

[57] ABSTRACT

A utility case for personal accessories and, in particular, for a lighter, a flashlight, and a measuring tape and which is distinctively made with a casing forming conveniently arranged compartments to replaceably fit modular accessory units therein. The casing includes a pair of upright compartments adjacent each other fore and aft of the casing and each having an open upper end. The modular flashlight unit and lighter unit removably fit in the upright compartments and have a switch and a flint wheel respectively which are arranged to be actuated by fore and aft motion of the same thumb.

4 Claims, 4 Drawing Figures

PORTABLE UTILITY CASE

This invention relates to a utility case of the portable type operatively enclosing accessories of common personal use, such as a lighter, a flashlight, and a measuring tape.

In the U.S. Pat. No. 2,494,886, there is defined a utility case which combines a cigarette lighter with a flashlight and in the U.S. Pat. No. 2,804,538, there is defined a utility case combining a measuring tape with a flashlight. In both of these references, the corresponding accessories have their parts separately mounted in the casing which forms the sole support for them. This presents inconvenience since, if one accessory fails, the whole case must be thrown away with the still good accessory since it is generally cheaper to replace the case than to have it repaired. Besides, such non-modular concept is generally more expensive to produce due to the number of special parts and the associated connections. The pivoting arrangement of the flashlight in the U.S. Pat. No. 2,494,886 results in relative complexity, cost, and malfunctioning.

It is a general object of the present invention to provide a portable utility case of the above type which is of modular construction wherein the accessories thereof constitute separately removable and replaceable modular units.

It is another object of the present invention to provide a portable utility case of the above type wherein accessories thereof are conveniently arranged for actuation by a single thumb and only one hand as the ordinary cigarette lighter is.

It is still another object of the present invention to provide a portable utility case of the above type which includes a casing forming convenient compartments for engagement of modular accessory units therein and in particular of a known lighter unit readily available on the market.

It is a further object of the present invention to provide a portable utility case of the above type which includes a flashlight unit and a measuring tape adapted to cooperate by forward projection of both the illumination and the tape for convenient use of the latter where and when illumination is otherwise lacking.

The above and other objects and advantages of the present invention will be better understood with reference to the following detailed description of a preferred embodiment thereof which is illustrated, by way of example, in the accompanying drawings, in which.

Figure 1:
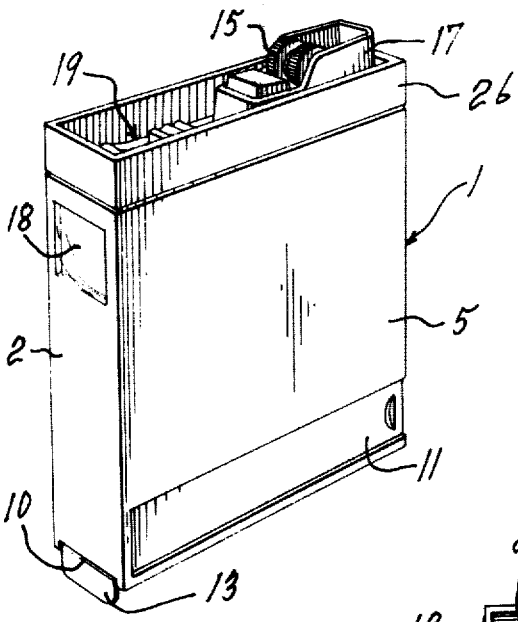
FIG. 1 is a perspective view of a portable utility case according to the present invention.
Figure 3:
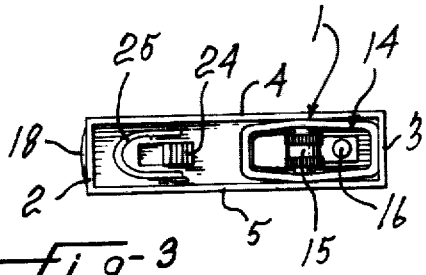
FIG. 3 is a top view of the portable utility case.
Figure 4:
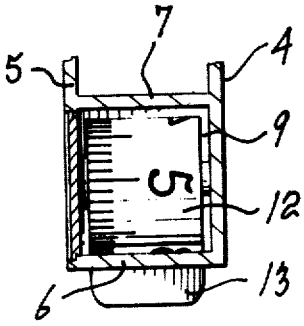
FIG. 4 is a cross-sectional view as seen along line 4—4 in FIG. 2.
Figure 2:
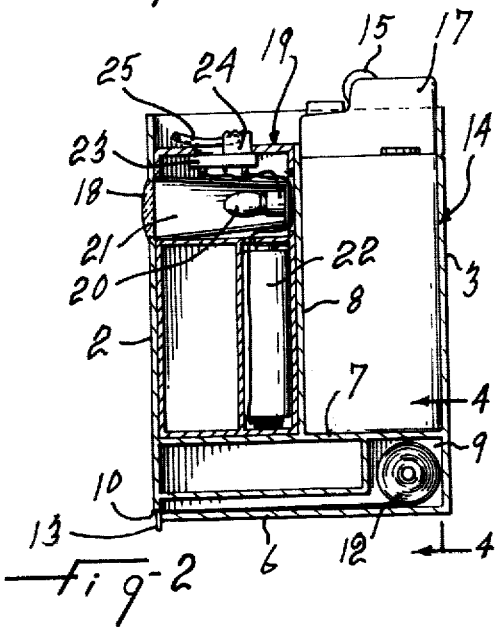
FIG. 2 is a cross-sectional view of the portable utility case as seen along a plane longitudinally thereof.

The illustrated portable utility case comprises a casing 1 of generally pocket size rectangular shape defining a front 2, a rear 3, opposite sides 4 and 5, and a bottom 6 with an open top. The casing 1 has a horizontal partition 7 and a transverse upright partition 8 cooperatively defining a bottom compartment 9 and a pair of upright compartments each having an open upper end. The upright compartments are positioned adjacent each other fore and aft of the partition 8. The front wall 2 is formed with a transverse slot 10 at its bottom. The lateral side wall 5 is provided with a sliding door 11 extending longitudinally of the casing 1 and laterally registering with the bottom compartment 9.

The sliding door 11 allows access into the bottom compartment 9 in which a measuring tape 12 is coiled. The tape 12 also has an operative outer end outwardly extending forward from the slot 10. A pullout tab 13 is secured to the edge of the measuring tape 12 and downwardly projects lower than the bottom 6.

A modular lighter unit 14 is fitted into the rear upright compartment. The lighter unit 14 may be of known type as are now readily available on the market or may be specifically sized to fit in the available space of the compartment. The lighter unit 14 includes a flint wheel 15, a wick 16, and a metal flame guard 17 which outwardly projects through the open top of the casing. The detailed construction of the modular lighter unit 14 does not form part of the present invention and need not be further defined.

The front wall 2 of the casing 1 is provided with a magnifying glass 18 forming a light transparent window therethrough. A modular flashlight unit 19 is fitted in the front upright compartment and includes a light bulb 20 and a reflector 21 operatively registering with magnifying glass 18 when the flashlight unit is fully engaged in the corresponding compartment. A battery 22 provides power to the light bulb 20 through a switch 23 whose button 24 is slidable fore and aft by the thumb with the same motion as the flint wheel 15 such that the case is operated with a single thumb and one hand only.

A hook 25 is pivoted to the flashlight unit on top thereof to be lifted for pulling out the same unit. A metal rim 26 is fitted to the periphery of the casing 1 around its open top.

What I claims is:

1. A utility case comprising a casing having a front wall provided with a window therein and with said casing defining a front and a back compartment, adjacent to each other, and each having an open upper end, said front compartment being provided with said window, a flashlight unit and a ligher unit operatively and removably fitting within said front and said back compartments, respectively, through said upper end, the flashlight unit including a first housing dimensioned to slidably and removably fit into front compartment, said first housing having a top wall, a light bulb and a light reflector mounted therein below said top wall and registering with said window to provide illumination therethrough when said first housing is operatively fitted within said front compartment, a battery and an electric circuit connecting said battery to said light bulb and housed within said first housing, an actuator switch connected in said circuit and mounted on said top wall of said first housing and accessible through the upper end of said front compartment, and a hook pivoted to the top wall of said first housing to be lifted for pulling of said flashlight unit from said front compartment, and said lighter unit including a second housing dimension to slidably and removably fit into said back compartment and having a head portion upwardly projecting through said open upper end of said back compartment, said portion including a wick, a manually-rotatable flint wheel and a flame guard, and wherein both said flint wheel and said actuating switch are actuatable by the same thumb in the same fore and aft direction relative to said casing.

2. A utility case as defined in claim 1, wherein said casing further includes a bottom compartment, said front wall is formed with a slot communicating with said bottom compartment, and a measuring tape is coiled into said compartment and operatively extends outwardly forward through said slot within the illumination field of said flashlight unit.

3. A utility case as defined in claim 2, wherein said casing includes a sliding access door in one lateral wall thereof operatively opening access into said bottom compartment to said coiled measuring tape.

4. A utility case as defined in claim 1, 2, or 3, wherein a magnifying glass is secured to said front wall and defines said window.

* * * * *